United States Patent [19]

Rohner, deceased et al.

[11] Patent Number: 4,897,991

[45] Date of Patent: Feb. 6, 1990

[54] METHOD AND APPARATUS FOR AUTOMATIC ORDERLY REMOVAL AND COLLECTION OF FULLY-SPUN COPS FROM TEXTILE RING SPINNING MACHINES

[75] Inventors: Joachim Rohner, deceased, late of Mönchengladbach, by Jutta Rohner, heir; Manfred Langen, Mönchengladbach; Gregor Gebald, Korschenbroich-Pesch, all of Fed. Rep. of Germany

[73] Assignees: Zinser Textilmaschinen GmbH; Innovatex Unternehemensberatung GmbH, both of Fed. Rep. of Germany

[21] Appl. No.: 114,874

[22] Filed: Oct. 28, 1987

[30] Foreign Application Priority Data

Oct. 28, 1986 [DE] Fed. Rep. of Germany ..... 3636654

[51] Int. Cl.[4] ..... D01H 9/18; D01H 9/02

[52] U.S. Cl. ..... 57/281; 57/266; 57/276; 209/927; 242/35.5 R

[58] Field of Search ..... 57/268, 266, 281, 276, 57/1 R; 242/35.5 R, 35.5 A; 209/927

[56] References Cited

U.S. PATENT DOCUMENTS

| | | | |
|---|---|---|---|
| 3,788,054 | 1/1974 | Haussmann et al. | 57/281 |
| 3,854,275 | 12/1974 | Bethea et al. | 57/281 |
| 3,924,762 | 12/1975 | Igel | 57/281 X |
| 4,088,226 | 5/1978 | Vicek et al. | 209/82 |

FOREIGN PATENT DOCUMENTS

| | | |
|---|---|---|
| 0047340 | 3/1982 | European Pat. Off. . |
| 2050928 | 4/1971 | Fed. Rep. of Germany . |
| 2028720 | 12/1971 | Fed. Rep. of Germany . |
| 2138926 | 2/1973 | Fed. Rep. of Germany . |
| 2252928 | 5/1974 | Fed. Rep. of Germany . |
| 2521370 | 11/1976 | Fed. Rep. of Germany . |
| 2637998 | 3/1977 | Fed. Rep. of Germany . |
| 2856026 | 7/1980 | Fed. Rep. of Germany . |
| 8328716 | 3/1984 | Fed. Rep. of Germany . |
| 3303733 | 8/1984 | Fed. Rep. of Germany . |
| 8321639 | 9/1985 | Fed. Rep. of Germany . |
| 60-119233 | 11/1985 | Japan . |
| 411653 | 11/1966 | Switzerland . |

*Primary Examiner*—John Petrakes

*Attorney, Agent, or Firm*—Shefte, Pinckney & Sawyer

[57] ABSTRACT

A method and apparatus for automatically removing and collecting in an orderly fashion fully-spun cops from a plurality of textile ring spinning machines wherein each ring spinning machine has a longitudinal conveyor for transporting doffed cops to one machine end and a movable cart is provided for transverse travel between the corresponding machine ends for collection of doffed cops from the machine conveyors. The cart carries a plurality of cop magazines and an associated means for automatically depositing cops into a magazine in a cop receiving position. Means are provided for automatically receiving and delivering doffed cops from the machine conveyors to the cop depositing means and means are further provided for automatically positioning the magazines one-by-one in proper cop receiving position with respect to the cop depositing means.

12 Claims, 2 Drawing Sheets

METHOD AND APPARATUS FOR AUTOMATIC ORDERLY REMOVAL AND COLLECTION OF FULLY-SPUN COPS FROM TEXTILE RING SPINNING MACHINES

BACKGROUND OF THE INVENTION

The present invention relates to a method and apparatus for automatically removing and collecting in an orderly manner fully-spun cops from a plurality of textile ring spinning machines and, more particularly, to such a method and appartus adapted for ring spinning machines of the type wherein cops are doffed simultaneously from all spinning stations of a machine and conveyed by a transpoert arrangement longitudinally along the ring spinning machine to one longitudinal end thereof for collection.

In such ring spinning machines, a plurality of spinning stations are located along the length of the machine at each opposite longitudinal side thereof, with a transport arrangement preferably in the form of a moving belt-type conveyor extending along the length of each side of the machine to the aforesaid longitudinal end thereof. As disclosed in West German Patentschrift DE 21 38 926, it is known to provide a stationary device at the longitudinal end of such a ring spinning machine in association with each of the two conveyors thereof for grasping and removing the doffed cops in groups as they are delivered to the machine end by the conveyor and then transferring the grasped cops to a movable storage device. In a known variation of this arrangement, the groups of cops removed from the conveyors are inserted onto storage plates having cop supporting pins which plates are moved manually by means of a cart under the stationary cop removal device. Such cop removal devices are considerably expensive and therefore cannot be justified in many instances since the stationary devices are utilized for only short intermittent periods when a doffing operation occurs at the associated ring spinning machine and otherwise remain inactive for relatively long periods between doffings.

It is also known to utilize a movable cart to travel transversely with respect to the ends of a plurality of ring spinning machines to selectively deliver an automatic cop exchanging device to any individual ring spinning machine for traveling movement therealong to previously perform at each spinning station a doffing and donning operation, i.e. removal of a fully-spun cop at each spinning station and replacement thereof with an empty spinning tube. This type of device is representatively disclosed in Japanese Patent Publication 60-119233. This device is also relatively expensive, while additionally suffering the disadvantage of requiring a considerable amount of time to accomplish a complete doffing and donning operation on a ring spinning machine.

It is not uncommon in the operation of ring spinning machines, particularly when spinning wool yarn, to spin yarns of the same count but otherwise differing yarn characteristics, e.g. fiber composition, color, or the like, at different sections or different sides of the same ring spinning machine. Thus, when fully-spun cops are removed from the ring spinning machine, it is necessary to sort the cops into respective containers, magazines or the like according to the differing yarn characteristics. In order to accomplish such a sorting operation utilizing known devices, it would be necessary to utilize relatively complex apparatus to support and control the several cop containers or magazines required, which as will be understood would be prohibitively expensive, particularly in light of the relatively length periods of inactivity of such devices between cop doffing operations.

In the field of open-end rotor spinning machines, it is known to utilize a removal cart by which yarn bobbins may be automatically doffed from a group of open end spinning machines and transferred to a separate depositing cart. In this arrangement, the bobbins are guided from the spinning machine to a storage point at which the bobbins may be individually removed and inserted onto support pins ion the depositing cart by means of a grasping device on the removal cart. The removal cart carries the depositing cart in proper relative position thereto. This arrangement is representatively disclosed in West German Gebrauchsmuster 83 21 639.1. While this arrangement functions acceptably with open end spinning machines, it is considered unsuitable for use with ring spinning machines due to the significant time required for the bobbin removal and depositing operation which typically requires approximately 8 seconds to accomplish. Thus, in a ring spinning machine having hundreds of spinning positions with hundreds of yarn cops at each side of the machine, the removal and depositing of fully-spun cops from any given machine would require several hours to complete, which is an unacceptably long period.

SUMMARY OF THE INVENTION

It is therefore an object of the present invention to provide a novel method and apparatus by which fully-spun cops, even cops having yarns of differing characteristics, may be removed from a plurality of ring spinning machines and collected in an orderly fashion.

As aforementioned, the type of ring spinning machine to which the present invention relates basically includes a transport means for conveying fully-spun cops after doffing longitudinally along the ring spinning machine to one longitudinal end thereof for collection. According to the method and apparatus of the present invention, a movable cart is provided having at least one container adapted for orderly arrangement therein of a plurality of fully-spun cops and associated means for automatically depositing cops into the container. The cart is automatically moved to the transport means at the one longitudinal end of each ring spinning machine following a doffing operation thereon. The cart includes appropriate means for automatically receiving and delivering doffed cops from the transport means of the ring spinning machines to the cop depositing means and other means for automatically positioning the container in a cop receiving position with respect to the cop depositing means, so that the automatic operation of the cop depositing means deposits the doffed cops in orderly arrangement in the container.

According to the preferred embodiment of the present method and apparatus, the cart is moved transversely between corresponding ends of the plurality of ring spinning machines, preferably by the provision of a track extending in such disposition, for automatically removing and collecting fully-spun cops at each machine. At least one station is provided for loading empty containers onto the cart and removing therefrom containers filled with full cops, preferably located at a side of the cart track opposite the ring spinning machines. The cart includes means for receiving empty containers from the station and means for transferring full containers to the station, the cart being automatically moved between the ring spinning machine and the station for automatically loading empty containers and removing full containers to and from the cart.

The cart is preferably provided with a movable extension on which the cop receiving and delivering means is located, the cop receiving and delivering means including a cop receiving device for preparing the cops for subsequent automatic processing and a transport device extending from the cop receiving device to the cop depositing means for transporting the cops thereto. As desired, the cart may also include means for adjustably positioning the cop depositing means relative to the container.

DESCRIPTION OF THE PREFRRED EMBODIMENT

Figure 1:
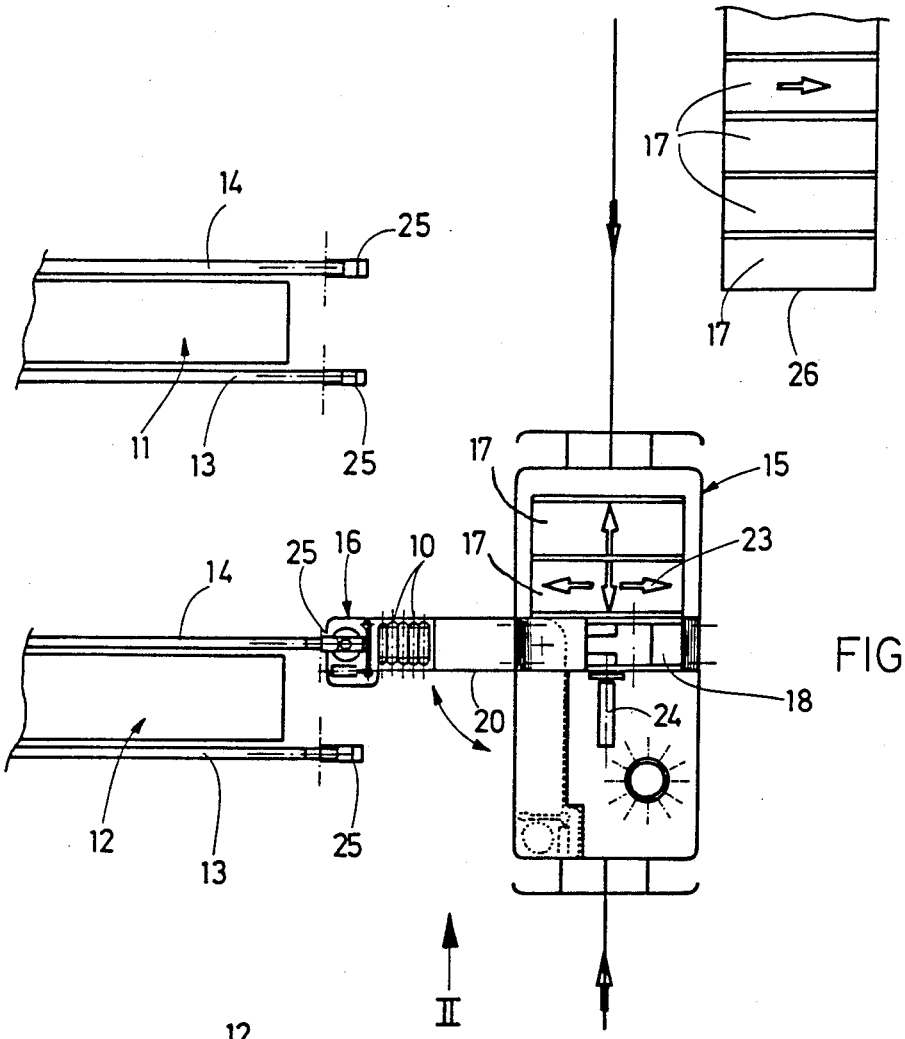
FIG. 1 is a schematic top plan view of the present cop removal and collecting apparatus arranged in association with ring spinning machines for carrying out the method of the present invention.

Referring now to the accompanying drawings and initially to FIG. 1, a pair of typical textile ring spinning machines are shown generally at 11 and 12 in side-by-side parallel facing relation to one another as representative of a conventional arrangement of a plurality of ring spinning machines as contemplated by the present invention. As will be understood, each ring spinning machine 11, 12 has a plurality of spinning stations arranged in alignment with one another along the opposite longitudinal sides of the machine, each spinning station having a ring spindle for supporting a yarn tube for winding of yarn throughout to produce a fully-spun yarn cop. Each of the ring spinning machines 11, 12 includes a transport arrangement 13, 14, each preferably in the form of a conveyor belt, extending longitudinally along the length of each side of the machine adjacent its spinning stations. In conventional manner, the plural yarn cops at the spinning stations of any given lengthwise side of the ring spinning machines 11, 12 are simultaneously doffed when fully spun and replaced by empty yarn tubes. The transport arrangements 13, 14 of each machine operate to convey empty yarn tubes to the individual spinning stations of the machines for grasping by a suitable doffing and donning device (not shown) to be exchanged for fully-spun cops when removed from the spindles of the spinning stations. Each transport arrangement 13, 14 further includes a plurality of cop holders arranged at spacings along the length of the transport arrangement to support the fully-spun cops, when doffed, as depicted by cops 10 in FIG. 2. Each transport arrangement 13, 14 travels in the direction of one longitudinal end of the associated ring spinning machine whereat the transport arrangements 13, 14 extend at an upward incline (FIG. 2) to a drop chute 25 located at the end of each transport arrangement 13, 14 for receiving the cops 10 as they fall gravitationally from the transport arrangements 13, 14. Each drop chute 25 is adapted to orient the cops 10 in a desired disposition in vertical alignment with one another.

According to the present invention, a movable cart 15 is provided for selective disposition at the cop discharge end of either ring spinning machine 11, 12 to receive the cops 10 from the respective drop chutes 25 and to collect and deposit the cops 10 in an orderly manner in a suitable container, such as compartmented magazines 17 carried on the cart 15. The cart 15 is provided with suitable wheels at least one of which is driven for traveling movement of the cart 15 along a floor-mounted trackway extending transversely between the corresponding cop discharge ends of the ring spinning machines 11, 12. The cart 15 is equipped with a device, representatively indicated at 16, for receiving the cops 10 as they are discharged from the bottom of the drop chute 25. The device 16 is preferably of the construction and operation of Swiss Patentschrift No. 411 653 to be adapted for not only maintaining the desired orientation of the cops 10 but also for preparing the cops 10 for subsequent automatic processing stations by locating the starting end of the yarn wound on each cop 10 and inserting the starting yarn end into the interior of the yarn tube of each cop 10. In this manner, the starting yarn end of each cop 10 is located at a defined position to enable it to be easily located automatically in a subsequent processing machine such as a winding machine.

A transport device 21, preferably a conveyor belt, is provided on the cart 15 adjacent the device 16 for receiving the prepared cops 10 as they are discharged form the device 16 and for transporting the cops 10 to a cop depositing device 18 on the cart 15 at the opposite end of the transport device 21. The device 16 and the transport device 21 are cooperatively arranged to position the prepared cops 10 in parallel disposition to one another lying transversely across the transport device 21 with respect to its direction of movement.

Several cop magazines 17 or other suitable containers are supported on the cart 15 by suitable holding fixtures 19 in two planes one above the other at an elevation above the cop depositing device 18. The holding fixtures 19 are preferably constructed in the form of an endless chain to permit the magazines 17 to be selectively moved in a circulating fashion one after the other into disposition over the depositing device 18. For example, the cart 15 may be provided with a pneumatic cylinder 24 for driving the holding fixtures 19 in circulating fashion to so position the magazines 17. Further, the cart 15 may include another drive arrangement by which the magazines 17 may also be shifted in a direction transverse to such circulatory movement, as indicated by the arrow 23 in FIG. 1, to enable the selective positioning of individual magazine compartments of the magazines 17 with respect to the cop depositing device 18. As an alternative to the transverse movability of the magazines 17, the cop depositing device 18 may be movably supported on the cart 15 for transverse movement with respect to the direction of cart travel to similarly position the cop depositing device 18 relative to individual magazine compartments within the magazines 17. In this manner, each individual magazine compartment in each magazine 17 may be selectively brought into a cop receiving disposition over the cop depositing device 18.

The cop depositing device 18 is adapted to receive the prepared cops 10 from the transport device 21 and insert the cops 10 into the cop receiving compartment of the magazine 17 positioned thereabove in the aforedescribed manner. For this purpose, the device 18 may preferably be of the construction and manner of operation disclosed in West German Offenlegungsschrift 20 28 720.

Figure 2:
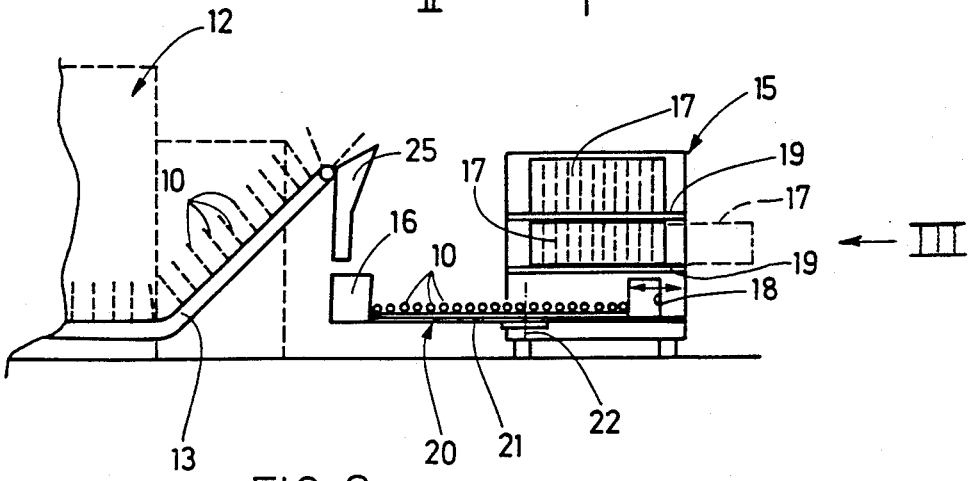
FIG. 2 is an elevational view of the cop removal and collecting apparatus and ring spinning machines of FIG. 1 as seen in direction of arrow II therein.
Figure 3:
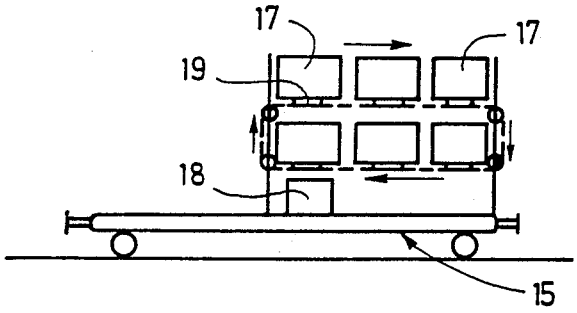
FIG. 3 is an end view of the cop removal and collection apparatus of FIGS. 1 and 2 as seen in the direction of arrow III in FIG. 2.

As best seen in FIGS. 1 and 2, the device 16 and the transport arrangement 21 are preferably disposed on an extension 20 pivotably mounted on the cart 15 for movement about a vertical shaft 22 to enable the device 16 and transport arrangement 21 to be selectively moved into and out of disposition beneath a drop chute 25 of either transport arrangement 13, 14 of either ring spinning machine 11, 12.

The present invention also includes at least one loading and unloading station 26 positioned for operative association with the cart 15 adjacent the cart trackway at the side thereof opposite the ring spinning machines 11, 12. The loading and unloading station 26 is utilized for storing empty magazines 17 and for receiving from the cart 15 full magazines 17 containing the fully-spun cops 10. Transferal of empty magazines 17 onto the cart 15 from the station 26 and to the station 26 from the cart 15 is accomplished by pneumatic presses or similar means mounted on the cart for grasping a magazine 17 and mounting and demounting it to and from the holding fixtures 19 of the cart 15. As desired, a separate loading station with empty magazines 17 and a separate unloading station for magazines 17 filled with spun cops 10 may be provided adjacennt the cart trackway.

For automatic operation of the cart 15, each ring spinning machine is provided with a signaling device (not shown) which is actuated upon the occurrence of a cop doffing operation thereon and the cart 15 is provided with a compatible receiver adapted to sense the individual signals from the ring spinning machines 11, 12. In addition, each ring spinning machine has a suitable information storage arrangement adapted to identify the number of machine stations having cops 10 of differing yarn characteristics. The cart 15 and each spinning machine 11, 12 are cooperatively arranged for docking of the cart 15 at each ring spinning machine in proper dispositon for receiving doffed cops from the associated transport arrangements 13, 14 of the machine and also to establish a suitable control connection between the cart 15 and the ring spinning machine by which a control arrangement within the cart 15 is operatively connected with the information storage arrangement of the ring spinning machine to determine the number and locations of doffed cops 10 having differing yarn charactersitics. The cop depositing device 18 of the cart 15 includes a counting device for determining the number of cops 10 deposited into each magazine 17.

The method of operation of the present apparatus will thus be understood. Following a doffing operation at either of the ring spinning machines 11, 12, the signaling device of the doffed ring spinning machine, represented by machine 12 in FIG. 1, communicates an appropriate signal to the cart 15 whereupon the cart 15 initiates traveling movement along its trackway to the spinning machine 12. The cart 15 is initially equipped with empty magazines 17. When the cart 115 arrives at the ring spinning machine 12, the cart extension 20 with the device 16 and the transport device 21 is pivoted outwardly from the cart 15 into docking disposition immediately adjacent the underside of one of the transport arrangements 13, 14 of the machine, represented by transport arrangement 14 in FIG. 1. At the same time, the aforementioned control connection is established between the cart 15 and the ring spinning machine 12 for control of the transport arrangement 14 and for determining the presence, location and number of cops 10 having differing yarn characteristics, if any. The transport arrangement 14 is actuated and the fully-spun cops 10 supported thereon are conveyed one-by-one into the drop chute 25 and therefrom into the device 16. As aforementioned, the starting end of yarn on each cop 10 is properly positioned by the device 16, after which the cops 10 are deposited onto the transport device 21 for conveyance to the cop depositing device 18 which progressively inserts the cops 10 into the magazine 17 positioned therabove.

As this operation progresses, the magazines 17 are moved transversely with respect to the cop depositing device 18 and are circulated in the above-described manner for filling of each magazine 17. For this purpose, the counting device of the cop deposing device 18 counts the number of cops 10 deposited into the active magazine thereabove and compares the number of deposited cops against the capacity of the magazine 17. When the counting device recognizes that the active magazine 17 has reached itts full capacity, the control arrangement of the cart 15 automatically actuates circulatory operation of the magazine support fixtures 19 to position an empty magazine 17 above the cop depositing device 18. In addition, the control arrangement of the cart 15 also actuates replacement of an active magazine 17 with another magazine 17, independently of the number of cops deposited into the active magazine 17, when the cop depositing device 18 receives cops having yarn of a differing characteristic as determined by the control connection established between the cart 15 and the ring spinning machine 12. In this manner, cops of differing yarn characteristics are sorted and deposited into separate magazines 17.

Once all of the fully-spun cops 10 have been removed and collected from the transport arrangement 14 at one side of the ring spinning machine 12, the cart 15 moves to the transport arrangement 13 at the opposite side of the ring spinning machine 12, whereupon the fully-spun cops 10 on the transport arrangement 13 are collected and deposited into the magazines 17 according to the identical process just described.

Once all of the cops 10 doffed from each side of the ring spinning machine 12 have been collected by the cart 15, the cart 15 travels to the loading and unloading station 26 whereat the cart 15 delivers the full magazines 17 to the station 26 and replaces the unloaded magazines with empty magazines. This process is also performed during the course of collection of cops 10 from one of the ring spinning machines in the event the control arrangement of the cart 15 determines that no more empty magazines 17 are available. After delivering the filled magazines 17 to the loading and unloading station 26 and obtaining empty magazines 17 therefrom, the cart 15 returns to the transport arrangement 13, 14 of the ring spinning machine and resumes the temporarily interrupted process of collecting and depositing the fully-spun cops 10 into the new empty magazines 17.

Thus, since the cart of the present invention is adapted for servicing a plurality of ring spinning machines, the present invention makes possible the nearly continuous removal and orderly collection of fully-spun cops with only relatively short intermittent periods of inactivity. As a result, a relatively high expense for the automated cop removal and collection provided by the present cart may be justified without substantially increasing the cost of individual ring spinning machines. Further, the present invention provides the advantage of enabling the collection of cops having yarn of differing characteristics through the provision of multiple cop magazines in the present cart.

It will therefore be readily understood by those persons skilled in the art that the present invention is susceptible of a broad utility and application. Many embodiments and adaptions of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for automatically removing and collecting in an orderly manner fully-spun cops from a plurality of textile ring spinning machines, each ring spinning machine being of the type wherein cops are conveyed after doffing by transport means longitudinally along the ring spinning machine to one longitudinal end thereof for collection, said method comprising the steps of providing a movable cart having at least one removable container adapted for orderly arrangement interiorly therein of a plurality of fully-spun cops, automatically moving said cart to the transport means at the one longitudinal end of each ring spinning machine following a doffing operation thereon, receiving the doffed cops by said cart from said transport means, automatically delivering the received cops to a cop depositing location on said cart, automatically positioning said container in a cop receiving position with respect to said cop depositing location, and automatically depositing the cops at said cop depositing location in orderly arrangement in said container.

2. A method according to claim 1 and characterized further by moving said cart transversely between corresponding ends of said plurality of ring spinning machines for automatically removing and collecting fully-spun cops at each spinning machine.

3. A method according to claim 1 and characterized further by, after receiving said cops by said cart and in advance of delivering said cops to said cop depositing location, automatically preparing said cops for subsequent automatic processing.

4. A method according to claim 1 and characterized further by moving said cart between the ring spinning machines and at least one loading and unloading station for loading of empty containers and removing of full containers to and from said cart.

5. Apparatus for automatically receiving and collecting in an orderly manner fully-spun cops from a plurality of textile ring spinning machines, each ring spinning machine being of the type having transport means for conveying cops after doffing longitudinally along the ring spinning machine to one longitudinal end thereof for collection, said apparatus comprising a cart automatically movable to the transport means at the one longitudinal end of each ring spinning machine for receiving the doffed cops therefrom following a doffing operation thereon, said cart including: (a) at least one removable container adapted for orderly arrangement interiorly therein of a plurality of fully-spun cops, (b) associated means for automatically deposting cops into said container, (c) means for automatically positioning said container in a cop receiving position with respect to said cop depositing means, and (d) means for automatically receiving and delivering doffed cops from said transport means of said ring spinning machines to said cop depositing means.

6. Apparatus according to claim 5 and characterized further in that said cart includes means for holding a plurality of said containers.

7. Apparatus according to claim 5 and characterized further in that said cop receiving and delivering means includes means for preparing said cops for subsequent automatic processing.

8. Apparatus according to claim 5 and characterized further in that said cart includes a movable extension on which said cop receiving and delivering means is located.

9. Apparatus according to claim 5 and characterized further in that said cop receiving and delivering means includes a cop receiving device for preparing said cops for subsequent processing and a transport device extending from said cop receiving device to said cop depositing means for transporting said cops to said cop depositing means.

10. Apparatus according to claim 5 and characterized further in that said cart includes means for adjustably positioning said cop depositing means and said container relative to one another.

11. Apparatus according to claim 5 and characterized further by at least one station for loading empty containers onto said cart and removing therefrom containers filled with said cops.

12. Apparatus according to claim 11 and characterized further by a track extending transversely of corresponding longitudinal ends of said spinning stations, said station being located at a side of said track opposite said ring spinning machines.

* * * * *